US007395586B1

(12) United States Patent
Gibson

(10) Patent No.: US 7,395,586 B1
(45) Date of Patent: Jul. 8, 2008

(54) SHOELACE RETENTION DEVICE

(76) Inventor: Sam Gibson, 320 McCullough, Sharpsville, PA (US) 16150

( * ) Notice: Subject to any disclaimer, the term of this patent is extended or adjusted under 35 U.S.C. 154(b) by 90 days.

(21) Appl. No.: 11/602,961

(22) Filed: Nov. 22, 2006

(51) Int. Cl.
*A43C 7/00* (2006.01)

(52) U.S. Cl. ..... 24/712.3; 24/712.2; 24/712.4; 24/712.5

(58) Field of Classification Search ..... None
See application file for complete search history.

(56) References Cited

U.S. PATENT DOCUMENTS 3,321,815 A * 5/1967 Herdman ..... 24/712.3
4,879,787 A * 11/1989 Walls ..... 24/712.2
5,029,371 A 7/1991 Rosenblood et al.
5,293,675 A 3/1994 Shai
5,649,342 A 7/1997 D'Andrade et al.
5,722,117 A * 3/1998 Nielsen ..... 16/428
5,918,352 A * 7/1999 Galbreath ..... 24/712.3
5,924,177 A 7/1999 Jongejan
6,338,186 B1 * 1/2002 Kleinmann ..... 24/712.2
6,588,078 B2 * 7/2003 Writt et al. ..... 24/712.2
6,952,864 B2 * 10/2005 Moreno ..... 24/712.3
6,988,298 B2 1/2006 Ternasky et al.

* cited by examiner

*Primary Examiner*—Jack W. Lavinder
(74) *Attorney, Agent, or Firm*—Harpman & Harpman

(57) ABSTRACT

A shoelace management and retainment device for temporarily retaining the loop and free ends of a shoelace bow formed on a shoe when tied. An open ended cylindrical sleeve of yieldable material is attached to portions of the shoelace extending through the eyelets of the shoe. An insertion opening is formed along the longitudinal length of the device into which the bow portion and shoelace ends of the shoelace is inserted translaterally so as to be positioned therewithin and extend partially out through corresponding respective distal end thereof.

7 Claims, 3 Drawing Sheets

SHOELACE RETENTION DEVICE

BACKGROUND OF THE INVENTION

1. Technical Field

This invention relates to shoes and specifically to shoelaces that are used to hold the shoes onto the user of a foot. A retainment knot and a releasable bow configuration is used to selectively and removably secure the ends of the shoelaces together after the lacing of the shoe and deals with the management and retainment of the tied shoelace in relation to the shoe itself.

2. Description of Prior Art

A number of prior art devices have been developed to address the issue of bow knot shoelace management which may come undone and interfere with the user, especially due to the rather increased length of modern shoelaces used on sport shoes and the like. Such devices can be seen, for example, in U.S. Pat. Nos. 5,029,371, 5,293,675, 5,649,342, 5,924,177 and 6,988,289.

U.S. Pat. No. 5,029,371 is directed to a locking device for elastic laces in which aligned clamping teeth extend from an interlocking retainment disk through which the laces are inserted and then retained.

U.S. Pat. No. 5,293,675 discloses fasteners for shoelaces in which a pair of apertured blocks are used in combination through which the individual laces are passed in a specific order and a block orientation to retain the laces.

U.S. Pat. No. 5,649,342 discloses a decorative attachment for securing laces together. A hinged enclosure having retainment engagement slits which are adapted to engage the shoelaces as they are pulled therethrough.

In U.S. Pat. No. 5,924,177 a shoelace retention device is claimed which is removably secured on the laces for retaining the blow elements thereof.

Finally, in U.S. Pat. No. 6,988,298 a footwear lace retention device is illustrated having lace insertion pocket with a closure flap overlying same.

SUMMARY OF THE INVENTION

A shoelace engagement and retainment device for holding the bow loops and associated lace ends in adjacent relation to the shoe. An elongated resilient split sleeve is attached to lower cross laces with the loop ends of the shoelace bow being inserted sideways through the split in the sleeve retaining same.

DESCRIPTION OF THE PREFERRED EMBODIMENT

Figure 1:
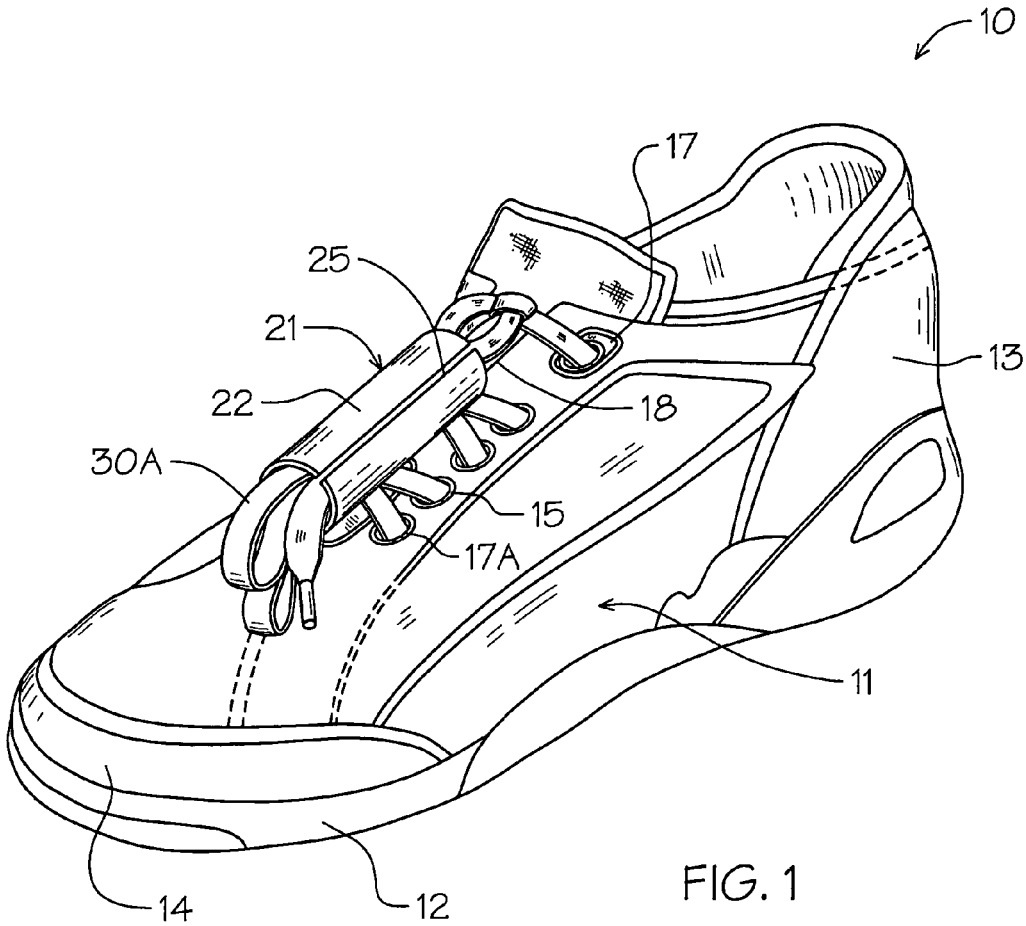
FIG. 1 is a perspective view of the shoelace retainment device of the invention in use on a sports shoe.

Referring to FIG. 1 of the drawings, an athletic sports shoe 10 can be seen having a main body member 11 with an integral sole 12 defining a heel portion 13 and a toe portion 14. The shoe 10 has a split lace engagement area 15 under which extends a shoe tongue 16. A plurality of longitudinally spaced lace engagement eyelets 17 are formed in parallel pairs along their respective longitudinal edges 18 of the lace engagement area 15 as will be well understood by those skilled in the art. A shoelace 19 having oppositely disposed lace ends 20 is drawn through the aligned opposing eyelet pairs 17 so as to interlace the lace engagement areas 15 together. Such shoelacing is typified by a criss-cross pattern in which the respective lace ends 20 are adjusted initially to be of equal length extending from a first eyelet pair 17A adjacent the toe portion 14 of the shoe 10. The laces are then crossed back and forth engaging the respective eyelets in a staggered criss-cross ascending pattern as noted.

Figure 2:
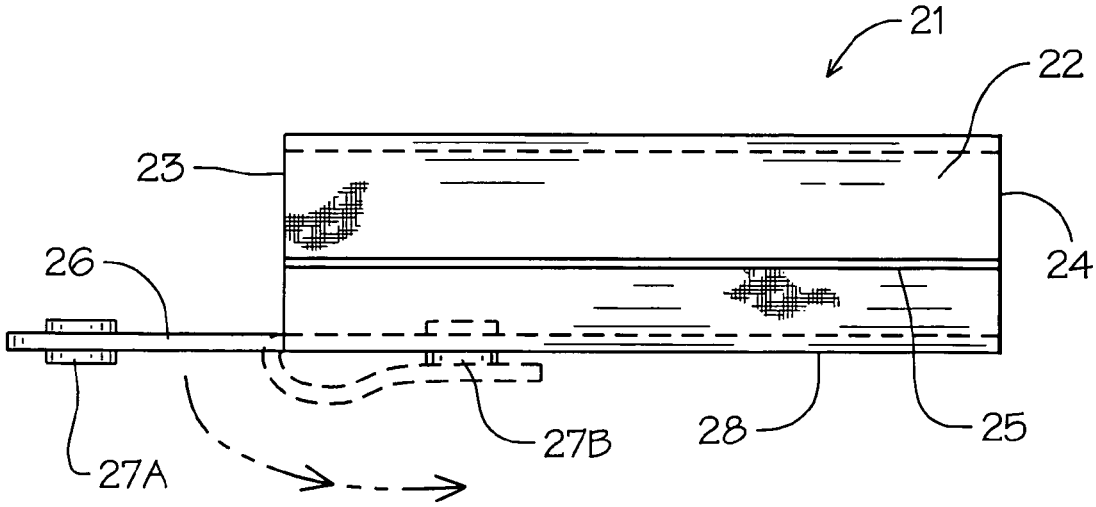
FIG. 2 is a side elevational view of the shoelace retaining device.
Figure 3:
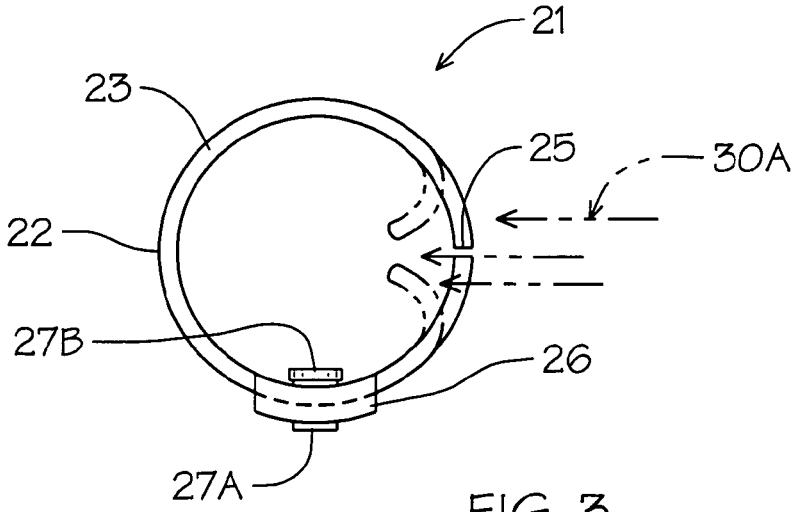
FIG. 3 is an enlarged front elevational view thereof.
Figure 4:
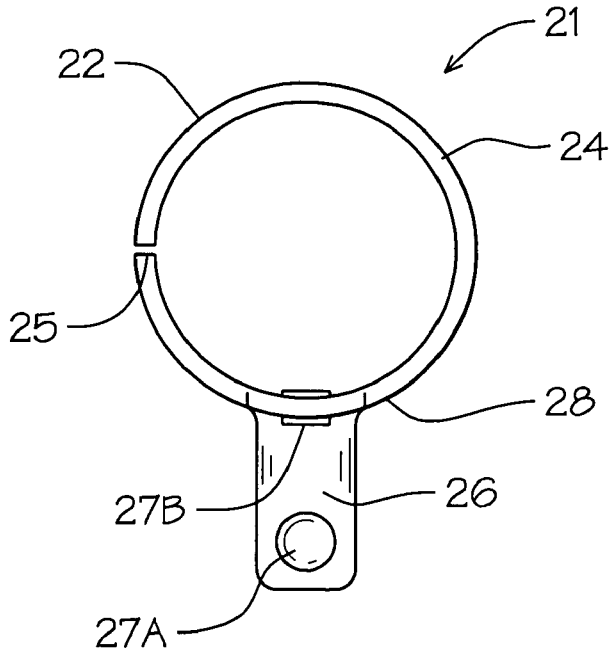
FIG. 4 is an enlarged rear elevational view thereof.

A lace retention device 21 of the invention, best seen in FIGS. 2-4 of the drawings, has a cylindrical body member 22 formed preferably of synthetic resin material of a yieldable deformable flexible nature having oppositely disposed open ends 23 and 24. The cylindrical body member 22 defines an annular wall with an access slit 25 extending longitudinally the length thereof between said respective ends 23 and 24.

An attachment tongue 26 extends integrally from the cylindrical end 23 having a fastener element 27A thereon with registering fastening elements 27B secured to the outer surface 28 of the cylinder body member 22 in inwardly spaced relation to the respective end 23 as best seen in FIG. 2 of the drawings.

Figure 5:
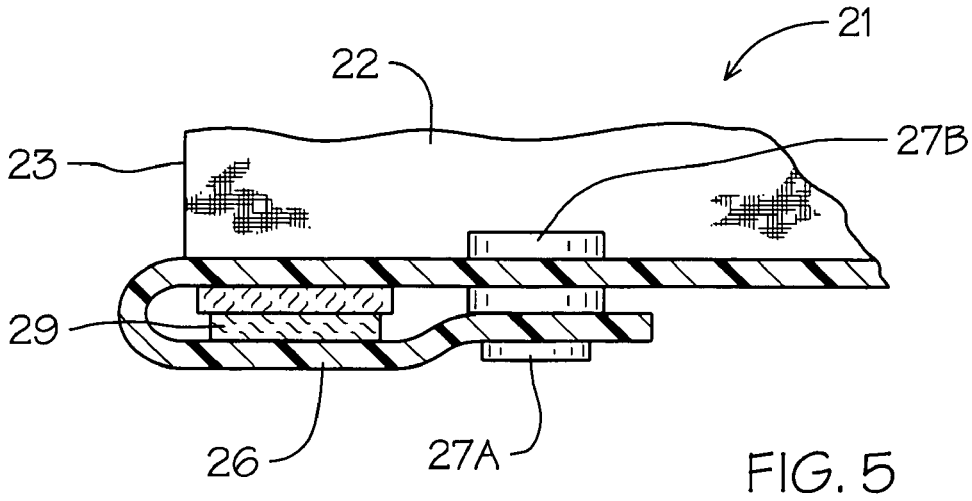
FIG. 5 is an enlarged partial cross-sectional view of the attachment tab engaged on a shoelace.

It will be evident from the above description that the attachment tongue 26 is bent back upon itself (as indicated in broken lines) so as to removably secure the lace retention device 21 of the invention in aligned registration by the respective interengaging fastening elements 27A and 27B. This affords removably attaching the lace retainment device 21 onto the shoe 10 by bending back and sliding the tongue 26 under a lace portion 29, best seen in FIG. 5 of the drawings, that extends transversely between the hereinbefore described opposing eyelet pairs 17A and registering engaging the fastening elements 27A and 27B as noted together as illustrated specifically in FIGS. 1, 3 and 5 of the drawings.

With the lace retention device 21 of the invention so attached, the shoelace ends 20 are tied into a traditional bow knot 30 as is well known in the art and the associated bow loops 30A of the knot and lace ends 20 inserted translaterally into the cylindrical main body member 22 via the elongated slit 25 therein. The yieldable nature of the cylindrical body member 22's material allows for easy deformability of adjacent cylindrical wall surfaces so defined by the slit 25 as seen in broken lines in FIG. 3 of the drawings. With the bow loops 30A and lace ends 20 positioned therewithin, the activation of the lace retainment device 21 of the invention is complete.

To remove the hereinbefore described lace elements from within the lace retention device 21, the user (not shown) simply pulls the lace elements back out thereof allowing the bow knot 31 to be released and subsequently the shoe removed in the usual manner.

It will be apparent that the cylindrical body member 22 will provide a usable display surface DS for imprinted or applied topical indicia related to sport teams, events and trade product identification logos and the like (not shown).

It will be evident that a new and novel shoelace retention device has been illustrated and described and it will be evident to those skilled in the art that various changes and modifications may be made thereto without departing from the spirit of the invention.

Therefore I claim:

1. A shoelace retention device for securing the bow loops and lace ends of a tied shoelace on a shoe comprising, a cylindrical body member removably secured on the laces of the shoe, an attachment tab extending from one end of said cylindrical body member, fastening means on said tab and said cylindrical body member for aligned registration with one another, an elongated access opening in said cylindrical body member and means for inserting said bow loop and lace ends into said cylindrical body member.

2. The shoelace retention device set forth in claim 1 wherein said fastening means on said tab is positioned adjacent its free end.

3. The shoelace retention device set forth in claim 1 wherein said fastening means on said cylindrical body member is positioned inwardly of its tab extending end.

4. The shoelace retaining device set forth in claim 1 wherein said access opening in said cylindrical body member comprises, a slit extending longitudinally therewithin.

5. The shoelace retaining device set forth in claim 1 wherein said cylindrical body member is of a yieldable, flexible synthetic resin material.

6. The shoelace retaining device set forth in claim 1 wherein said means for inserting said bow loop and lace ends in said cylindrical body member comprises, translateral deformation and separation of said cylindrical body member along the elongated access opening defined therewithin.

7. The shoelace retention device set forth in claim 1 wherein said attachment tab registerably engages over a portion of said shoelace extending between apertured eyelets.

* * * * *